US007387502B1

(12) United States Patent
Rawlings et al.

(10) Patent No.: US 7,387,502 B1
(45) Date of Patent: Jun. 17, 2008

(54) METHOD AND APPARATUS FOR ELIMINATION OF GASES IN PUMP FEED/INJECTION EQUIPMENT

(75) Inventors: David Rawlings, Sound Beach, NY (US); Harry E. Pinkerton, III, Bayville, NY (US)

(73) Assignee: Fluid Metering, Inc., Syosset, NY (US)

( * ) Notice: Subject to any disclaimer, the term of this patent is extended or adjusted under 35 U.S.C. 154(b) by 448 days.

(21) Appl. No.: 11/226,733

(22) Filed: Sep. 14, 2005

Related U.S. Application Data

(60) Provisional application No. 60/612,621, filed on Sep. 23, 2004, provisional application No. 60/610,471, filed on Sep. 16, 2004.

(51) Int. Cl.
*F04B 17/00* (2006.01)

(52) U.S. Cl. ..... 417/350; 417/368; 417/370; 210/244; 210/245; 137/210; 137/216; 285/133.4; 285/133.5; 95/241; 95/260; 96/95; 96/155; 415/56.4; 415/56.5

(58) Field of Classification Search ..... 417/150, 417/160, 199.2, 217, 234, 236, 237, 313, 417/318, 329, 350, 368, 370, 371, 408, 423.14–423.15, 417/430, 502; 403/150; 210/172.3, 188, 210/190, 191, 197, 207, 244, 245, 246, 248, 210/249, 268, 749, 750, 754, 756, 915; 137/210, 137/216, 572, 599.14, 599.15, 834, 841, 137/842; 285/133.4–133.5, 924; 95/241, 95/260; 96/95, 155, 204, 206; 49/373, 374, 49/381, 404; 160/44, 332, 335, 336, 349.1; 415/56.4, 56.5, 58.4, 92, 116, 121.2, 121.3, 415/144, 169.1, 169.2, 201
See application file for complete search history.

(56) References Cited

U.S. PATENT DOCUMENTS

| | | | | |
|---|---|---|---|---|
| 3,637,081 | A * | 1/1972 | Bradley | 210/110 |
| 4,941,809 | A | 7/1990 | Pinkerton | |
| 5,015,157 | A | 5/1991 | Pinkerton et al. | |
| 5,020,980 | A | 6/1991 | Pinkerton | |
| 5,044,889 | A | 9/1991 | Pinkerton | |
| 5,092,037 | A | 3/1992 | Pinkerton | |
| 5,551,469 | A * | 9/1996 | Woerheide | 137/8 |
| 6,852,219 | B2 * | 2/2005 | Hammond | 210/222 |
| 2004/0020866 | A1 * | 2/2004 | Hammond et al. | 210/767 |
| 2004/0141023 | A1 | 7/2004 | Nakamura | |
| 2004/0173531 | A1 * | 9/2004 | Hammond | 210/650 |

FOREIGN PATENT DOCUMENTS

GB 2239676 A * 7/1991

* cited by examiner

*Primary Examiner*—Ninh Nguyen
*Assistant Examiner*—Amene S Bayou
(74) *Attorney, Agent, or Firm*—Hoffmann & Baron, LLP

(57) ABSTRACT

A pumping apparatus for pumping a liquid from a source to a target including a motor, a first pump driven by the motor, a second pump driven by the motor and a separator in fluid communication with the first and second pump for separating a liquid received from a source into a gaseous component and a liquid component. The separator further diverts the gaseous component to the first pump and the liquid component to the second pump, wherein the first pump pumps the gaseous component back to the source and the second pump pumps the liquid component to a target.

20 Claims, 3 Drawing Sheets

METHOD AND APPARATUS FOR ELIMINATION OF GASES IN PUMP FEED/INJECTION EQUIPMENT

CROSS-REFERENCE TO RELATED APPLICATIONS

This application claims the benefit of U.S. Provisional Application No. 60/610,471, filed on Sep. 16, 2004 and U.S. Provisional Application No. 60/612,621, filed on Sep. 23, 2004.

FIELD OF THE INVENTION

The present invention relates generally to liquid pumping systems, wherein one liquid is pumped or fed into the stream of another liquid. More particularly, the present invention relates to a method and apparatus that minimizes gases in the liquid pumping system.

BACKGROUND OF THE INVENTION

There are situations in which it is necessary to inject or feed one liquid into the stream of another liquid. Some liquid pumping systems require an occasional injection of liquid while others need a more continuous feed of the liquid. Still others might require a combination of the two. For purposes of this disclosure, it is understood that the term "feed" will include inject.

One such common application is in the field of water treatment wherein certain chemicals, such as chlorinating solutions, fluorination chemicals and other liquids, are fed into the water stream at a point prior to its delivery for end use by consumers. It is important to maintain certain percentage levels of these added liquids in order to assure adequate functionality without exceeding predetermined concentrations which could be objectionable or even harmful to the consumer.

A variety of apparatus is available in the industry to perform this chemical feed task. Such apparatus typically takes the form of a pump, wherein pump speed and chemical feed rate is controlled by well known electronic means which employs chemical concentration detection means and provides voltage or current signal output for use by the pump drive system to adjust its feed rate. This system operates in a closed loop fashion to maintain a relatively stable concentration of the desired chemical in the water stream.

Certain chemicals, particularly sodium hypochlorite (NaOCl) solution used for chlorination of the water system, exhibit the troublesome characteristic of constant gas generation. Specifically, the liquid NaOCl spontaneously outgases in such a way that bubbles form in conduit piping, fittings and any other cavities in the feed circuit. Positive displacement pumps attempting to draw this liquid from storage tanks and feed it into the water stream can become gas-bound when encountering such gas bubbles. Once gas-bound, the pump will simply work against a "springy" bubble, which will alternately compress and expand to entirely devour the pump's displacement stroke volume. At this point, feeding of liquid chemical into the water stream ceases and the pump will uselessly run without effect.

This problem is aggravated by the often encountered requirement to feed the liquid chemical directly into a pressurized water stream. Here, even a modest sized gas bubble will give rise to a gas bound condition as the pump unsuccessfully attempts to compress the gas sufficiently to force it out of the pump chamber against the water stream back pressure. The problem is sufficiently severe that certain water treatment facilities undertake the extra step of diluting the sodium hypochlorite solution in the liquid chemical supply tank in order to reduce gas bubble formation. It can be reliably stated that the most aggravating problem known in the water chlorination and disinfection industry is the off-gas generated by the sodium hypochlorite NaOCl solution.

Another related problem is associated with priming. Once a chemical vessel is emptied, the feed apparatus will draw in air and entirely fill the intake circuit (including tubing, fittings, internal chambers and such) with this air. The chemical concentration detection apparatus will then signal or alarm for intervention by a technician. Chemical feed restoration now requires that a full liquid chemical vessel be substituted for the empty vessel followed by a troublesome and time consuming sequence of valve openings/closings by a skilled technician to bleed offending air out of the circuit in order to prime the pump. Only after the technician confirms by observation that the feed pump is actually feeding liquid into the water stream can the task be considered completed. This problem of manual bleeding is common to any liquid chemical application and is in addition to and apart from the out-gassing characteristics of NaOCl solutions.

Numerous attempts have been made to solve the problems described herein. For example, it is known in the field to incorporate a solenoid operated purge valve in a liquid pump, which is manually or automatically operated to divert the pressure output port of the feed pump away from the pressurized water stream and back to the liquid chemical supply tank. Once liquid has filled the pump circuit, the valve is shifted back so as to direct the chemical liquid into the pressurized water stream. However, the drawbacks of such prior art solutions include complex electronics, additional valves, manual intervention or urgent attention on the part of technicians.

Accordingly, it is desirable to provide a simply designed system, wherein gas bubbles are dispatched automatically while replacement of an empty liquid chemical supply tank and commissioning of a new full tank is simply done by switching input tubing from the empty to the full tank. It would be further desirable to provide an apparatus requiring no priming and does not require the pump to be turned off when changing liquid supplies.

SUMMARY OF THE INVENTION

The present invention is a pumping apparatus for pumping a liquid from a source to a target including a motor, a first pump driven by the motor, a second pump driven by the motor and a separator in fluid communication with the first and second pump for separating a liquid received from a source into a gaseous component and a liquid component. The separator further diverts the gaseous component to the first pump and the liquid component to the second pump, wherein the first pump pumps the gaseous component back to the source and the second pump pumps the liquid component to a target.

In a preferred embodiment, the separator is a T-fitting having a downward oriented arm for separating the liquid component under the influence of gravity and permitting horizontal flow of the gaseous component. The apparatus further preferably includes a substantially vertically oriented tube connecting the downward arm of the T-fitting to the pump. Also, the motor, the first pump and the second pump are substantially horizontally arranged.

The pumping apparatus of the present invention is preferably contained in a portable and mountable case having an inlet mounted thereon for fluidly connecting the separator to the liquid source, a gas outlet mounted thereon for fluidly connecting an output port of the first pump to the liquid source and a liquid outlet mounted on the case for fluidly connecting an output port of the second pump to the target. The case further preferably includes a hinged cover for permitting access to the motor, pumps and separator contained in the case and a drain outlet for draining any fluid leakage from the interior of the case. The hinged cover may be suspended from the case in a substantially horizontal position by a lanyard.

The pumping apparatus is further preferably provided with a wash-water subsystem for cleaning the first and second pumps. The wash-water subsystem preferably includes tubing connected to the first and second pumps for delivering wash-water to the pumps and a flow restrictor for regulating the flow of the wash-water to the pumps.

The present invention further involves a method for pumping a liquid from a source to a target. The method generally includes the steps of separating the liquid into a gaseous component and a liquid component, diverting the gaseous component to a first pump, diverting the liquid component to a second pump, pumping the gaseous component back to the liquid source with the first pump and pumping the liquid component to the target with the second pump.

Thus, the present invention calls for the use of a separate pump whose function is to draw whatever is in the intake line up to a point above the intake for the primary feed pump. At this point there is a T-fitting with a large diameter pipe connection leading downwards to the intake port of the main feed pump. The output line of the first pump is connected to tubing which leads back to the liquid chemical supply tank. There is little or no restriction to the flow of liquid through the first pump so it experiences no difficulty drawing gas, liquid or a combination thereof out of the chemical supply tank and returning it back again to this same tank.

As liquid or gas passes over the down facing port of the T-fitting on its way to the input of the first pump, liquid falls down under the influence of gravity to the intake port of the primary feed pump (second pump). This intake port, in turn, is angled upwards so that it becomes flooded with liquid. A suitably designed pump is then able to self clear small amounts of gas so long as its intake port is flooded with liquid.

As a result of the present invention, an apparatus is provided which utilizes a novel means for dealing with the presence of gas in the liquid chemical intake plumbing. Also, the design of the present invention further provides the ability to self prime against a pressurized system, even in the event of total gas entrainment into the intake liquid circuit. Thus, the present invention is particularly suitable for use as part of a chlorination system for delivering a chlorine solution into a water supply.

The preferred embodiments of the apparatus and method of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
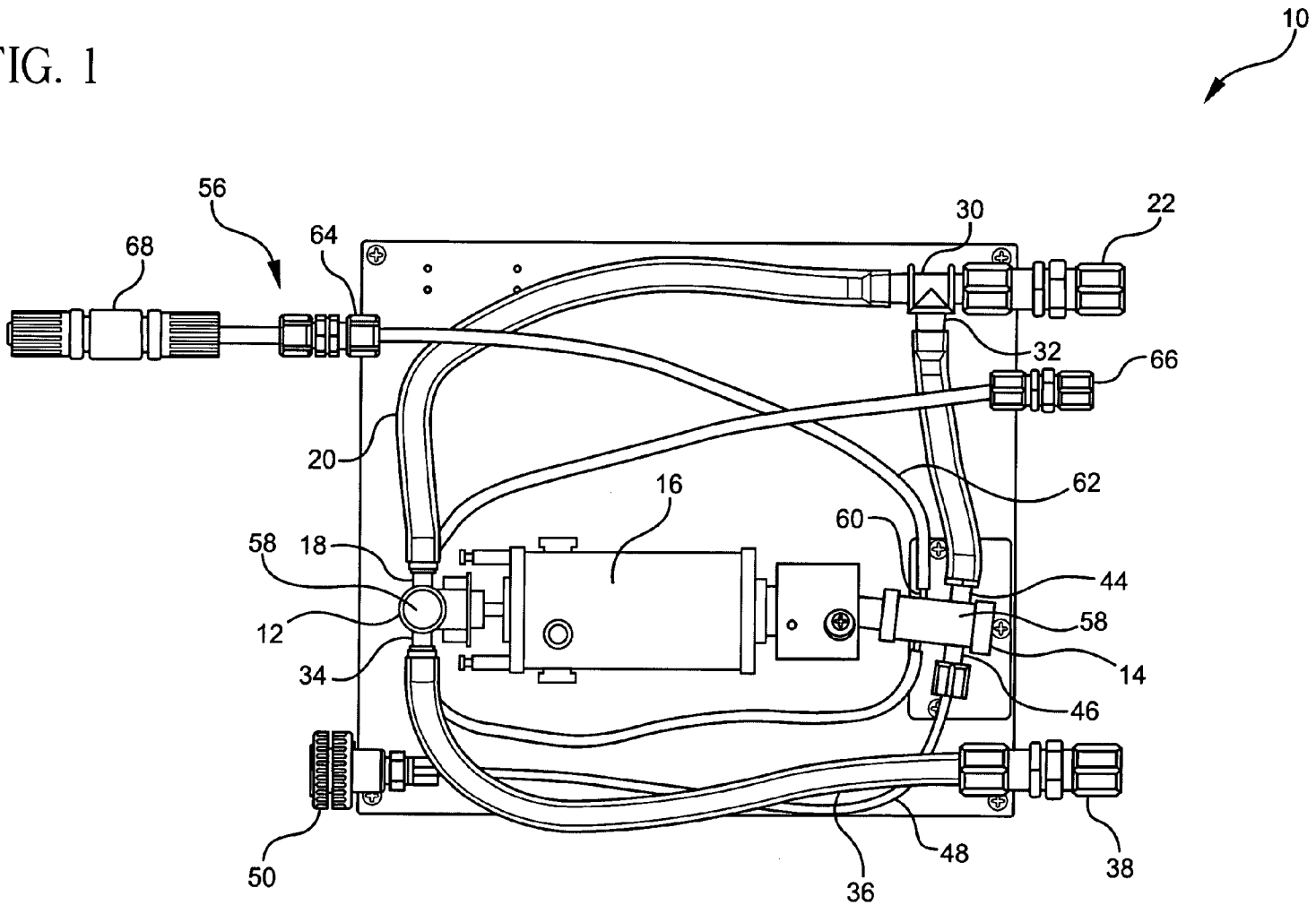
FIG. 1 is a cross-sectional view of the preferred embodiment of the pumping apparatus formed in accordance with the present invention.
Figure 2:
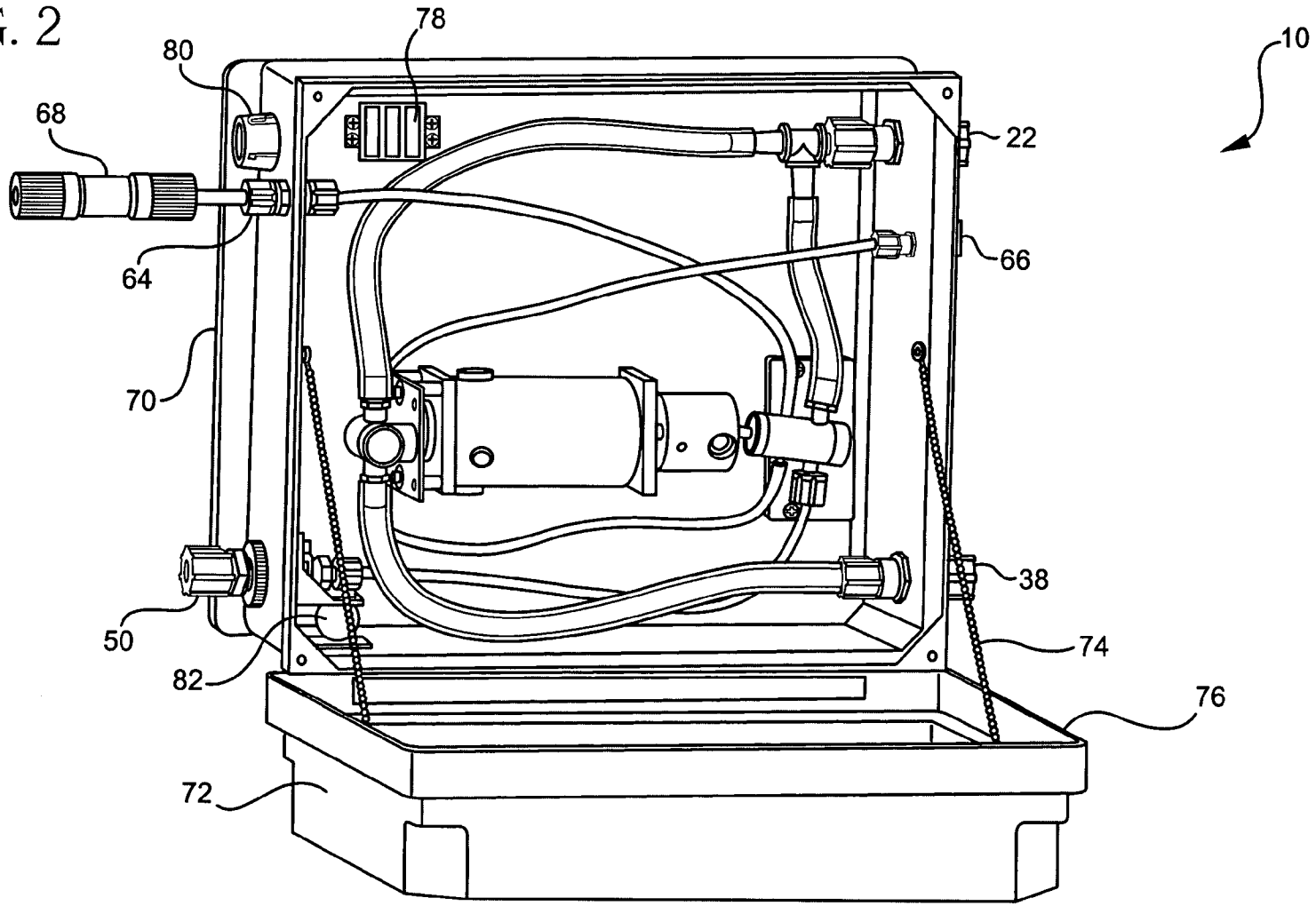
FIG. 2 is a perspective view of the pumping apparatus shown in FIG. 1 contained in a compact mountable case.

FIGS. 1 and 2 illustrate the preferred embodiment of the present invention. The present invention is a pumping apparatus 10, which generally includes a first pump 12 and a second pump 14 coaxially mounted to and driven by a motor 16. When the motor 16 is energized it drives both pumps 12 and 14 simultaneously.

Pumps 12 and 14 are preferably positive displacement pumps oriented in a horizontal arrangement wherein the axes of the pumps are horizontal with respect to the motor 16, as shown in FIG. 1. A desirable pump for use in the present invention as the first pump 12 is the "RO Pump" supplied by Fluid Metering, Inc., Syosset, N.Y. (www.fmi-pump.com). A desirable pump for use in the present invention as the second pump 14 is the "Q-1CTC Pump" also supplied by Fluid Metering, Inc.

Figure 3:
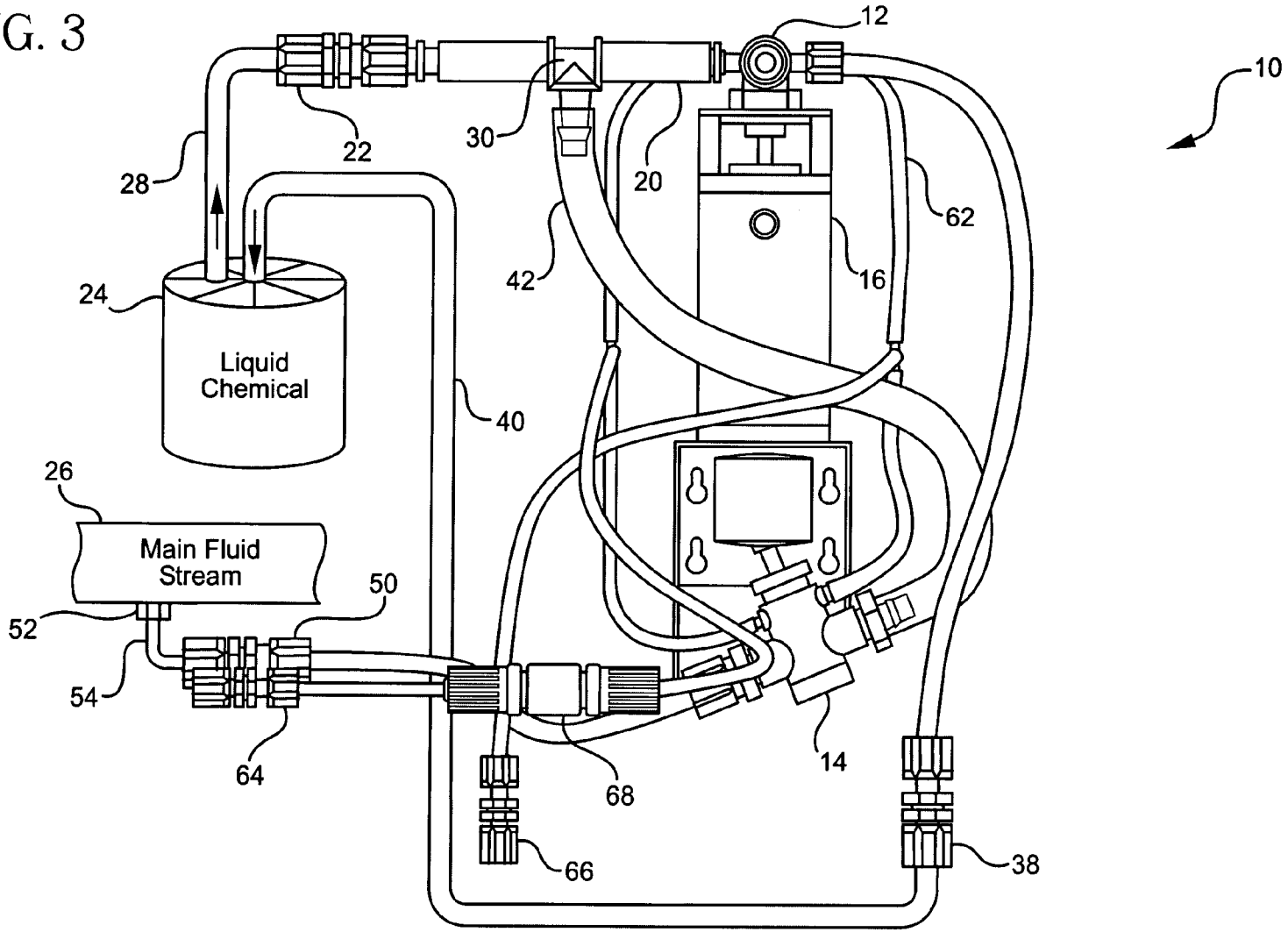
FIG. 3 is a cross-sectional view of an alternative embodiment of the pumping apparatus formed in accordance with the present invention.

While the first pump 12 is being driven by the motor 16, it draws a liquid into its intake port 18 via an intake conduit 20. At its opposite end, the intake conduit 20 is connected to an inlet 22, which in turn is adapted to be connected to a liquid source, such as a cistern 24 containing a chemical to be injected or fed into a main fluid stream 26, as shown in FIG. 3. The inlet 22 is preferably a quick-connect type fitting adapted to be fluidly connected to a hose, a pipe or other type of conduit 28 leading to the liquid source 24.

Interposed along the path of the intake conduit 20, between the intake port 18 of the pump 12 and the inlet 22, is a separator 30 for separating the liquid supplied from the liquid source 24 into a gaseous component and a liquid component. The separator 30 is preferably a junction, such as a T-fitting, oriented along the path of the intake conduit 20 to facilitate horizontal flow through the fitting and having one arm 32 oriented vertically downward. In this manner, as a gas/liquid mix passes through the T-fitting 30, the liquid component of the mixture falls downward through the vertical arm 32 of the fitting under the influence of gravity.

Any gaseous component of the liquid fed through the inlet 22 flows horizontally through the T-fitting 30 and is drawn into the intake port 18 of the first pump 12. This gaseous component is then discharged out of an output port 34 of the first pump 12 into a gas return tube 36, which terminates at a gas outlet 38 of the apparatus 10. The gas outlet 38 is also preferably a quick-connect type fitting adapted to be connected to a return line 40 running back to the liquid source 24, as shown in FIG. 3.

The vertical arm 32 of the T-fitting 30 is connected to a vertically oriented, large diameter liquid feed tube 42, which, at its opposite end, is connected to an intake port 44 of the second pump 14. This liquid feed tube 42 is preferably of large enough bore to avoid trapping bubbles under a liquid column. Experimentation has suggested that tubing with an internal diameter of about ⅜" works nicely in this regard.

The vertical orientation of the liquid feed tube 42 further ensures that the degassed liquid which has fallen down from the vertical arm 32 of the T-fitting 30 displaces any gas at the intake port 44 of the second pump 14. As a result, the second pump 14 is now self-priming.

The second pump 14 discharges the degassed liquid out of an output port 46 into a liquid discharge tube 48, which is connected to a liquid outlet 50. The liquid outlet 50 is again preferably a quick-connect type fitting, which is adapted to be connected to an inlet 52 of the main fluid stream 26 via a liquid feed line 54, as shown in FIG. 3. The second pump 14 thus delivers the degassed liquid to the main fluid stream 26 against the pressure head of the main supply.

The system 10, according to the present invention, further preferably includes a wash-water subsystem 56 for lubricating and cleaning out the pumps 12 and 14. Specifically, each pump head 58 of the pumps 12 and 14 preferably include a feature called an "Isolation Gland" or "Wash Gland" wherein the pump head includes a pair of extra ports 60 which are connected to wash-water lines 62. The wash-water lines 62 fluidly connect a wash-water supply port 64 to a wash-water waste port 66, wherein the pump heads 58 may be connected in series along the wash-water line path, as shown in FIGS. 1 and 2, or they may be connected in parallel, as shown in FIG. 3.

The wash-water subsystem 56 further preferably includes a flow restrictor 68 for restricting the flow of the incoming wash-water into the wash-water supply port 64 before the water enters the pump heads 58. A suitable flow restrictor for use in the present invention is a 150 mL/min restrictor.

The wash-water subsystem 56 provides the function of maintaining clean pumps as described above and also provides a sort of lubrication to help the pump start up after extended periods of non-operation. The purpose of the flow restrictor 68 in the present invention is to regulate the amount of wash-water which is introduced into the wash glands of the two pump heads 58. Municipal water sources generally provide water at elevated pressure (upwards of 100 psig) and connections are made to large gate valves at convenient plumbing locations. Thus, regulation of water flow from these large valves, which normally are used to control rates of tens of liters per minute, through the device becomes important. The flow restrictor 68 eliminates any need on the part of the installer or maintenance technicians to adjust their water supply flow rate or pressure.

The pump system 10, according to the present invention, is preferably contained in a compact mountable box or case 70, as shown in FIG. 2. In particular, the components of the system 10 are conveniently contained within a case 70 having a hinged cover 72 with the inlet 22, the gas outlet 38, the liquid outlet 50, the wash-water inlet 64 and the wash-water outlet 66 extending from the exterior of the case. Thus, the case 70 can be mounted to a wall, for example, wherein the system 10 can be connected to on-site fluid lines via the various fluid connections 22, 38, 50, 64 and 66 which extend outside of the case.

In this regard, the cover 72 is preferably hinged to the case 70 to open in a downward direction when the case is mounted to the wall. The cover 72 further preferably includes at least one lanyard 74 for suspending the cover in a horizontal orientation with respect to the case. In this manner, the cover 72 provides a shelf for placing tools or other items during servicing or repair of the system. Preferably, the cover 72 defines an interior compartment 76 for holding such tools or spare parts.

The case 70 further provides convenient structure for mounting an electrical terminal 78 for providing electrical power to the motor 16 from an electrical source via electrical wiring (not shown) fed through an external electrical port 80 of the case. The electrical terminal 78 and port 80 are preferably mounted to an interior surface of the case generally above the pumping components so that any leakage in the system will not come into contact with the electrical connections of the terminal.

The case 70 further preferably includes a drain outlet 82 provided in a bottom surface of the case to drain any leakage in the system out of the case. The drain outlet 82 is preferably in the form of a check-valve or a ball-valve, which permits only one-way fluid flow out of the case 70. As a result, exterior contaminants are prevented from entering the case.

As mentioned above, the pumps 12 and 14 and the motor 16 are oriented horizontally. The purpose for this orientation is to prevent any possible damage to the electric motor 16 from liquid leakage which might issue from a pump 12 or 14. Specifically, when the pumps 12 and 14 are oriented horizontally with respect to the motor 16, any leakage from a pump will simply fall to the bottom of the case 70 and will be drained out of the case via the drain outlet 82.

An added advantage in orienting the assembly horizontally is improved performance with respect to liquid/gas separation. The horizontal assembly arrangement as shown in FIGS. 1 and 2 allows for a relatively straight vertical liquid feed tube 42, which facilitates bubbles rising to the top thereby readily separating the entrained gas bubbles. The full range of flow angles for the pumps 12 and 14 (typically ranging from 7.5°-to-22°) are accommodated by this arrangement.

Nevertheless, it is totally conceivable to orient the pumps 12 and 14, with respect to the motor 16 in a vertical arrangement, as shown in the alternative embodiment of FIG. 3. This may be necessary, for example, due to the on-site limitations in installing the system. In this embodiment, the first pump 12 is positioned above the motor 16 and the second pump 14 is positioned below the motor. Operation of the system 10, however, is identical to that described above.

The present invention is particularly suitable for implementation as part of a chlorination system, wherein relatively small amounts of sodium hypochlorite (NaOCl) solution are injected or fed into a water stream. Such chlorination systems include those utilized by municipal water providers and swimming pool facilities.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A pumping apparatus for pumping a liquid from a source to a target comprising:

a motor;

a first pump driven by said motor;

a second pump driven by said motor; and a separator in fluid communication with said first and second pump for separating a liquid received from a source into a gaseous component and a liquid component, said separator further diverting the gaseous component to said first pump and the liquid component to said second pump, wherein said first pump pumps the gaseous component back to the source and said second pump pumps said liquid component to a target.

2. A pumping apparatus as defined in claim 1, wherein said separator utilizes gravity for separating said liquid into said gaseous component and said liquid component.

3. A pumping apparatus as defined in claim 2, wherein said separator is a T-fitting having a downward oriented arm for separating said liquid component under the influence of gravity and permitting horizontal flow of said gaseous component.

4. A pumping apparatus as defined in claim 3, further comprising a substantially vertically oriented tube connecting said downward arm of said T-fitting to said second pump.

5. A pumping apparatus as defined in claim 1, wherein said motor, said first pump and said second pump are substantially horizontally arranged.

6. A pumping apparatus as defined in claim 1, further comprising a case for containing said motor, said first pump, said second pump and said separator therein.

7. A pumping apparatus as defined in claim 6, further comprising:

an inlet mounted on said case for fluidly connecting said separator to the liquid source;

a gas outlet mounted on said case for fluidly connecting an output port of said first pump to the liquid source; and a liquid outlet mounted on said case for fluidly connecting an output port of said second pump to the target.

8. A pumping apparatus as defined in claim 6, wherein said case includes a hinged cover for permitting access to said motor, said first pump, said second pump and said separator.

9. A pumping apparatus as defined in claim 8, further comprising a lanyard for suspending said cover from said case in a substantially horizontal position.

10. A pumping apparatus as defined in claim 6, wherein said case includes a drain outlet for draining any fluid leakage from the interior of said case.

11. A pumping apparatus as defined in claim 1, further comprising a wash-water subsystem for cleaning said first and second pumps.

12. A pumping apparatus as defined in claim 11, wherein said wash-water subsystem comprises:

tubing connected to said first and second pumps for delivering wash-water to said pumps; and a flow restrictor for regulating the flow of the wash-water to said pumps.

13. A method for pumping a liquid form a source to a target comprising the steps of:

separating the liquid into a gaseous component and a liquid component;

diverting said gaseous component to a first pump;

diverting said liquid component to a second pump;

pumping said gaseous component back to the liquid source with said first pump; and pumping said liquid component to the target with said second pump.

14. A method as defined in claim 13, wherein said liquid component is separated from said gaseous component by gravity.

15. A chlorination system for feeding a chlorine solution into water comprising:

a source of chlorine solution;

a motor;

a first pump driven by said motor;

a second pump driven by said motor; and a separator in fluid communication with said source of chlorine solution and said first and second pumps for separating chlorine solution received from said source into a gaseous component and a liquid component, said separator further diverting said gaseous component to said first pump and said liquid component to said second pump, wherein said first pump pumps said gaseous component back to said chlorine solution source and said second pump pumps said liquid component into a supply of water.

16. A chlorination system as defined in claim 15, wherein said separator utilizes gravity to separate said chlorine solution into said gaseous component and said liquid component.

17. A chlorination system as defined in claim 16, wherein said separator is a T-fitting having a downward oriented arm for separating said liquid component under the influence of gravity and permitting horizontal flow of said gaseous component.

18. A chlorination system as defined in claim 15, further comprising a case for containing said motor, said first pump, said second pump and said separator therein.

19. A chlorination system as defined in claim 18, further comprising:

an inlet mounted on said case for fluidly connecting said separator to said chlorine solution source;

a gas outlet mounted on said case for fluidly connecting an output port of said first pump to said chlorine solution; and a liquid outlet mounted on said case for fluidly connecting an output port of said second pump to the supply of water.

20. A chlorination system as defined in claim 15, further comprising a wash-water subsystem for cleaning said first and second pumps.

* * * * *

UNITED STATES PATENT AND TRADEMARK OFFICE

CERTIFICATE OF CORRECTION

PATENT NO. : 7,387,502 B1
APPLICATION NO. : 11/226733
DATED : June 17, 2008
INVENTOR(S) : Rawlings et al.

It is certified that error appears in the above-identified patent and that said Letters Patent is hereby corrected as shown below:

IN THE SPECIFICATION:

Column 2, Line 7 now reads "NaOCI"
should read --NaOCl--

Signed and Sealed this

Sixteenth Day of June, 2009

John Doll

JOHN DOLL
*Acting Director of the United States Patent and Trademark Office*